US005702001A

United States Patent [19]

Russell et al.

[11] Patent Number: 5,702,001

[45] Date of Patent: Dec. 30, 1997

[54] CONTAINER AND METHOD FOR RELAXING SNAGS DURING DISPENSEMENT OF STRIP MATERIAL

[75] Inventors: William E. Russell, Middletown, R.I.; Barrie G. Hall, Ontario, Canada; Fernando Medeiros, East Freetown, Mass.

[73] Assignee: The Moore Company, Westerly, R.I.

[21] Appl. No.: 291,619

[22] Filed: Aug. 17, 1994

[51] Int. Cl.[6] ..... B65D 85/00

[52] U.S. Cl. ..... 206/388; 53/436; 53/449; 220/403; 220/772; 222/1; 222/183

[58] Field of Search ..... 53/429, 436, 449; 206/388, 417; 220/403, 404, 766, 772, 6, 7; 222/1, 173, 179.5, 183; 242/47, 170, 172, 360

[56] References Cited

U.S. PATENT DOCUMENTS

| | | | |
|---|---|---|---|
| 1,219,969 | 3/1917 | Lowe | 220/772 |
| 1,942,713 | 1/1934 | Klinka | 220/7 |
| 2,471,095 | 5/1949 | Coit, Jr. . | |
| 2,542,920 | 2/1951 | Gardner | 220/7 |
| 2,804,227 | 8/1957 | Elfgren . | |
| 3,968,877 | 7/1976 | Mattis | 206/388 |
| 4,098,424 | 7/1978 | Liebscher et al. . | |
| 4,324,172 | 4/1982 | Cazals et al. . | |
| 4,897,982 | 2/1990 | Day et al. . | |
| 4,946,036 | 8/1990 | Kupersmit . | |
| 5,002,194 | 3/1991 | Nichols . | |
| 5,261,550 | 11/1993 | Karpisek . | |

*Primary Examiner*—Jimmy G. Foster
*Attorney, Agent, or Firm*—Darby & Darby

[57] ABSTRACT

A container having panels that contain a bag of strip material. The container is movable between a confining position enclosing the bag of strip material and a position in which the bag is relaxed so as to relax snags of looped elastic material that may have arisen during transit. During transit, the strip material has a tendency to flow from the top and over the edges of the bulk to work its way along the sides, potentially snagging with adjacent loop material. During dispensement of the strip material, these snags may give rise to tension spikes. By displacing the panels of the container out of the confining position and into a relaxed position, the confining forces become relieved and thereby the snags relax. The tension spikes otherwise arising during dispensement are thereby eliminated.

5 Claims, 4 Drawing Sheets

FIG.1
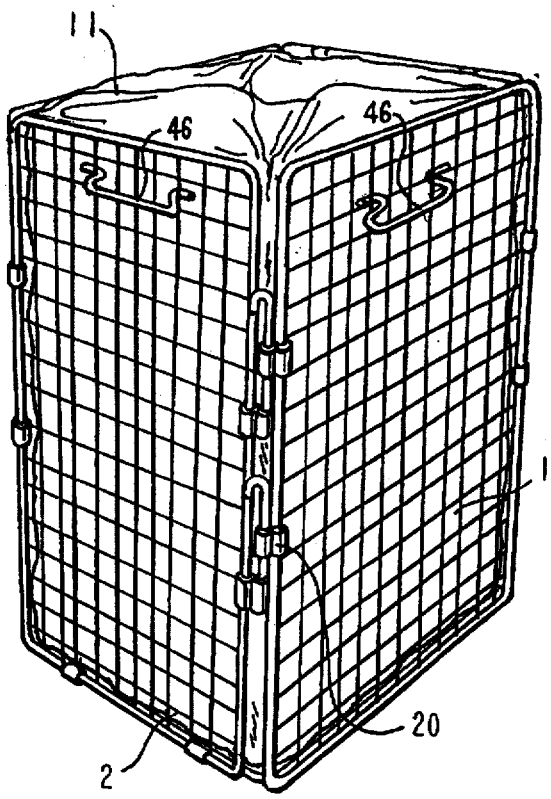
FIG.2
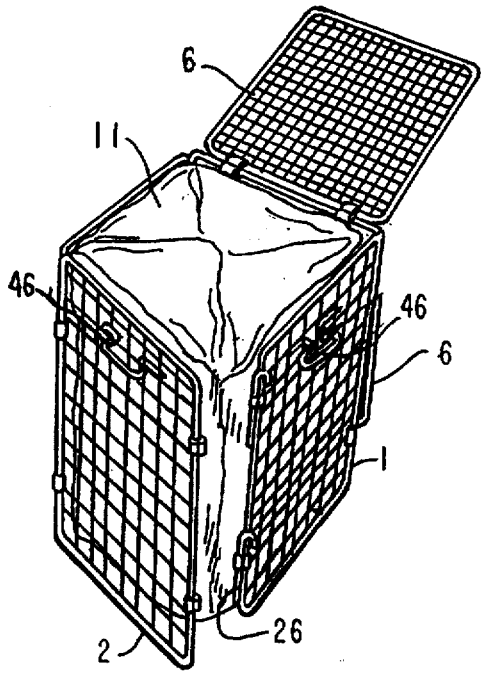
FIG.3
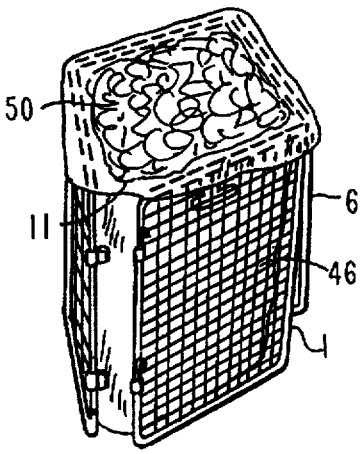
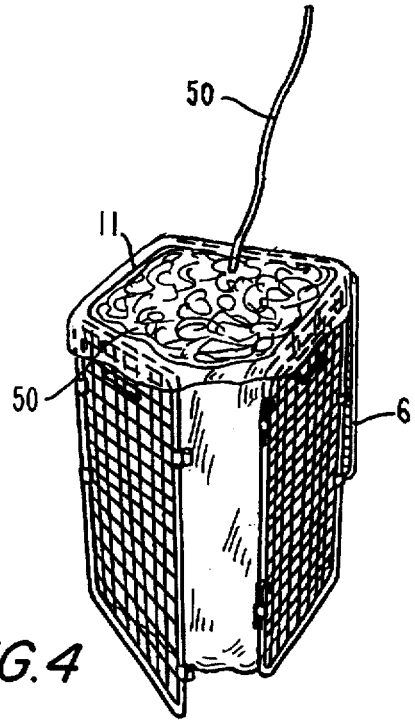
FIG.4

CONTAINER AND METHOD FOR RELAXING SNAGS DURING DISPENSEMENT OF STRIP MATERIAL

BACKGROUND OF THE INVENTION

The present invention relates generally to containers and methods of containment and dispensement for use in transporting goods, such as for the bulk transport of strip material to manufacturers of end use products.

Traditionally, strip material, including elastic strip material, has been transported in cardboard boxes or cartons, which are subsequently discarded. A conventional plastic lined container for dispensement of elastic strip material is described in U.S. Pat. No. 4,897,982 assigned to Fulflex International Co., of Limerick, Ireland, whose contents are incorporated herein by reference. That patent discloses the dispensement of elastic strip material from a plastic lined container, the container being formed by folding a corrugated paper blank into a box.

During transport of the packaged elastic strip material in the box, harmonics may build up and if the box vibrates sufficiently, the elastic strip material flows from the top and cascades over the edges and works its way along the sides of the box. Occasionally, this cascading effect causes loops of the elastic strip material to become trapped or snagged between sides of the box and the adjacent elastic strip material inside. Under such a condition, a tension spike is induced by the trapped or snagged loop where it is taut during dispensement of the elastic strip material at very high speed at a set tension for a given application. Tamping down the elastic strip material before shipping helps counter this cascading effect, but tension spikes may still arise despite the tamping down.

The tension spike, when factored in with the normally applied tension imposed by a machine pulling out the elastic strip material for a given application, may be sufficient to cause the elastic strip material to snap or break during dispensement. Such breakage is, of course, unacceptable from a product quality standpoint.

Indeed, even if the elastic strip material does not break, the tension fluctuation caused by the tension spike may degrade product quality to such an extent that the elastic strip material might just as well have broken during dispensement. Typical applications for dispensement of elastic strip material demand that the elastic strip material be dispensed under a fairly consistent and uniform tension. The failure to do so leads to unwanted defects in the product being formed, such as for end products like diapers or golf balls. It would therefore be desirable to eliminate tension spikes during dispensement of the elastic strip material.

SUMMARY OF THE INVENTION

One aspect of the present invention relates to a container for, and a method of, relaxing snagged loops of strip material and thereby eliminate tension spikes otherwise arising during dispensement of the strip material under tension. The container preferably has panels connected to each other that confine the strip material, but are displaceable out of the confining position and into a relaxed position to relieve the confining forces.

By relieving the confining forces, displaced panels effectively relax the snags to eliminate the condition giving rise to the creation of tension spikes during dispensement. The quality of the end product made from the dispensed strip material is thereby enhanced because the tension remains consistent and uniform throughout the dispensement of the strip material, regardless of whatever cascading effect or displacement of the strip material may have arisen during shipment. The relieving of the confining forces also lessens frictional resistance during the dispensement of the strip material and allows all tangles to come out.

It is preferred that the container enclose a flexible bag or other flexible package filled with elastic strip material for shipment. After arrival of the container, its panels are displaced manually out of their confining position so that they no longer exert confining forces on the elastic strip material. The flexible bag or other flexible package may, at this point, be taken out of the container, set down where it will generally retain its shape, and then opened to commence dispensement. Otherwise, the flexible bag or other flexible package may remain on top of the bottom panel of the container and opened to commence dispensement. When the dispensement is complete, the flexible bag or other flexible package is removed and the container is collapsed into a substantially flattened state for recycling.

BRIEF DESCRIPTION OF THE DRAWING

For a better understanding of the present invention, reference is made to the following description and accompanying drawings, while the scope of the invention is set forth in the appended claims.

FIG. 1 is a perspective view of a container in accordance with the invention. An adjacent front and left hand side panels are shown in a closed condition. The container holds a closed bag of elastic strip material.

FIG. 2 is a perspective view of the container of FIG. 1, except with the adjacent front and left hand side panels in the open condition. The top panel is being opened.

FIG. 3 is a perspective view of the container of FIG. 2 with a top portion of the bag opened to reveal its contents of strip material.

FIG. 4 is a perspective view of the container of FIG. 1 with a leading end of elastic strip material dispensing through the bag opening while the front panel and left hand panels are spaced apart from each other in an open position.

DESCRIPTION OF THE PREFERRED EMBODIMENT

Figure 9:
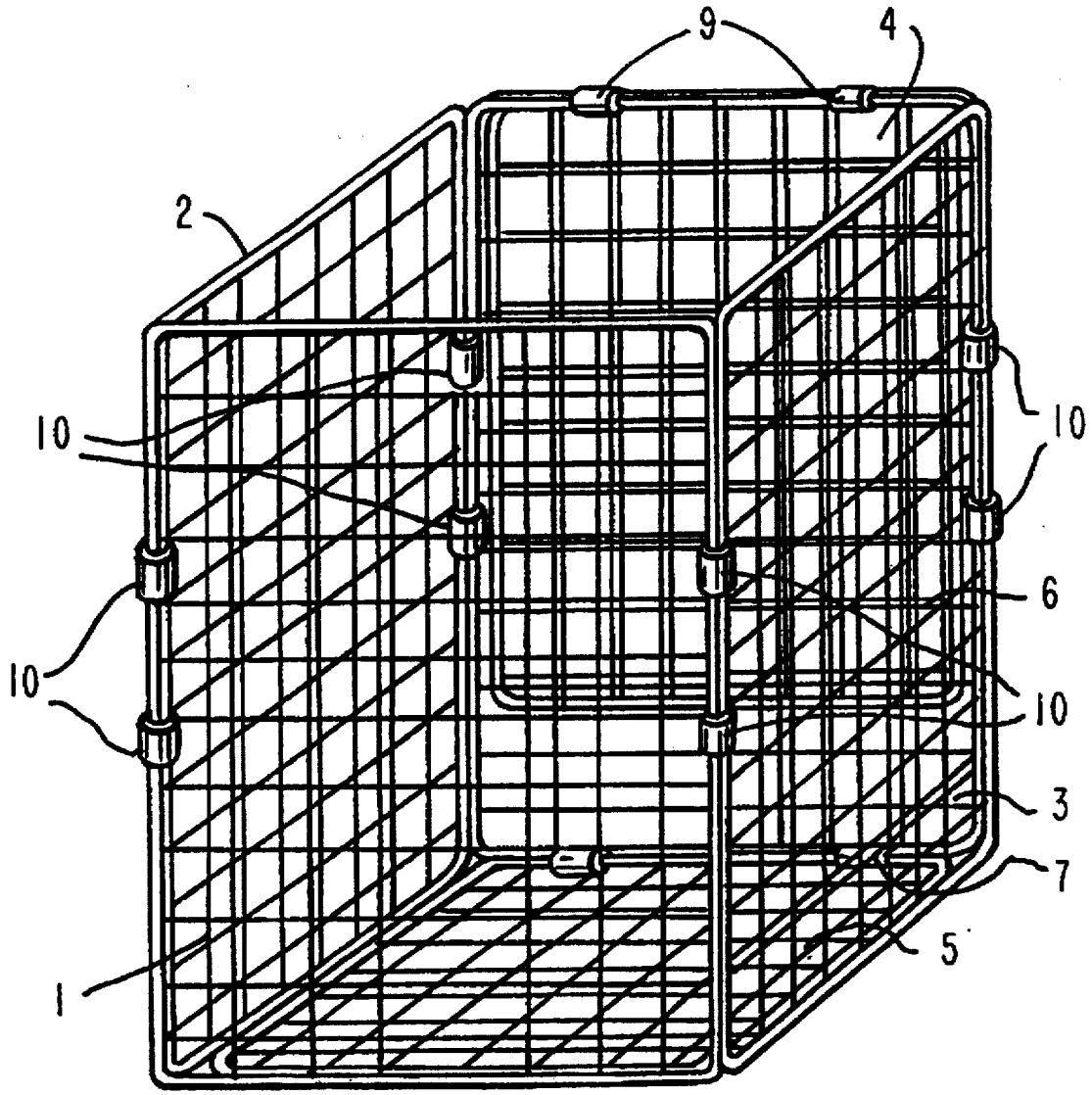
FIG. 9 is a perspective view of a container in an erect state and empty, open for receiving a load, as disclosed in Irish application no. S930941.
Figure 10:
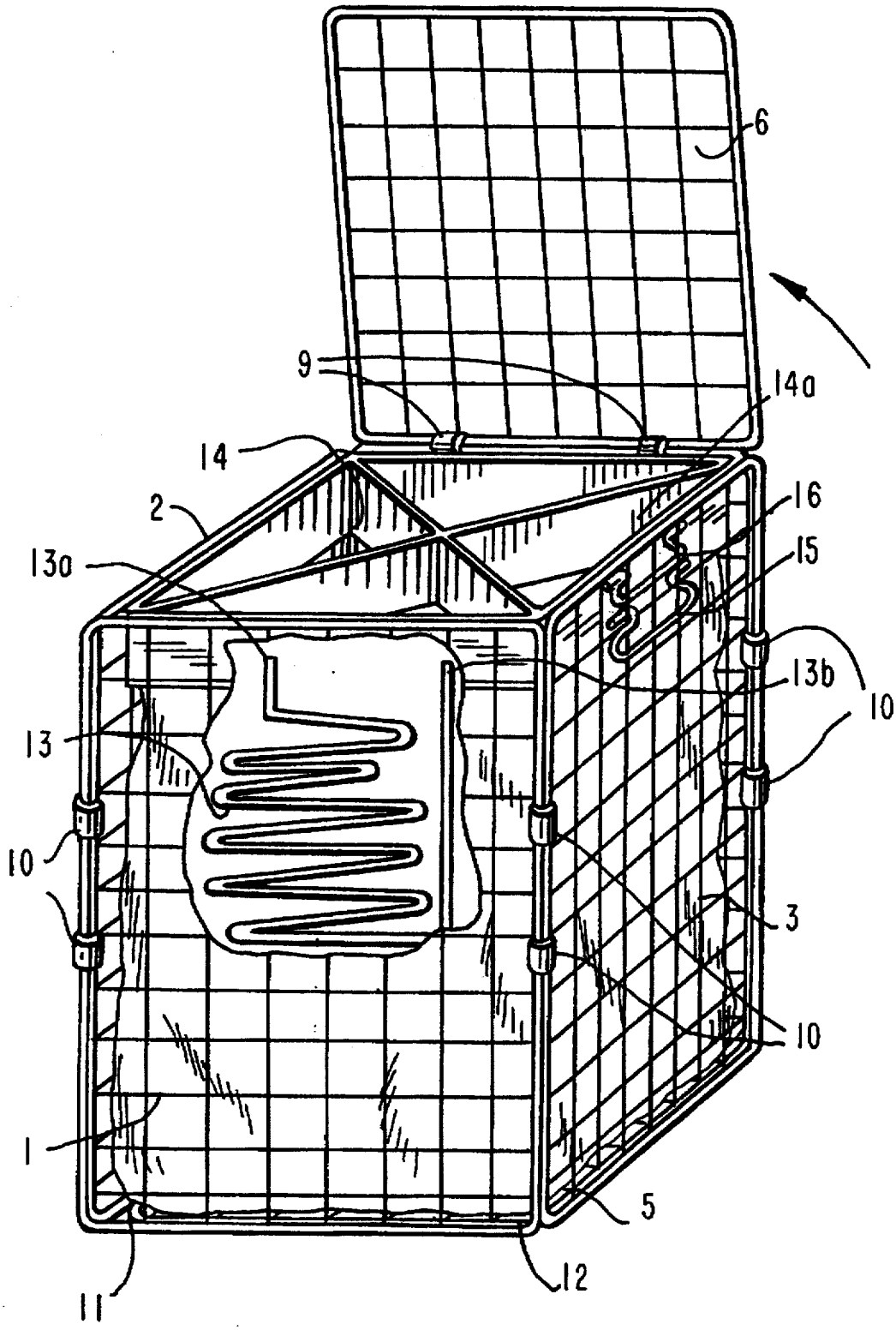
FIG. 10 is a perspective view of the container of FIG. 9 but showing the container partly cut away to illustrate a load contained therein.

Prior to describing the invention in detail, reference is made to FIGS. 9 and 10, which relate to a container as disclosed in Irish patent application no. S930941 and assigned to Fulflex International Company of Ireland. The present invention is a modification of that container.

Referring to the container depicted in FIG. 9, there are six panels, a front panel 1, a left hand side panel 2, a right hand side panel 3, a rear panel 4, a floor panel 5, and a roof panel 6. Each panel 1, 2, 3, 4, 5, 6 is made of an outer metal frame surrounding a metal mesh or other suitable material. The panels 1, 2, 3, 4, 5, 6 are hinged together as will now be described.

The floor panel 5 is connected by means of a pair of hinges 7 to the lower edge of the rear panel 4. The floor panel 5 is movable between a horizontal position, shown in FIG. 9, in which the floor panel rests on a pair of brackets 8 projecting backwardly from the lower edge of the front panel 1 and a vertical position in which the floor panel is pivoted upwardly to rest against the inside face of the rear panel 4.

The roof panel 6 is pivotally connected by means of a pair of hinges 9 to the upper edge of the rear panel 4. The roof panel 6 is movable between a first position, shown in FIG. 9, in which it depends downwardly on the outside face of the rear panel 4 and a second position (not shows) resting on the upper edges of the front panel 1, left hand side panel 2, and right hand side panel 3.

Further pairs of hinges 10 are provided connecting the front panel 1 to the left hand side panel 2, connecting the left hand side panel 2 to the rear panel 4, connecting the rear panel 4 to the right hand side panel 3, and connecting the right hand side panel 3 to the front panel 1. As shown in FIG. 9, the container is erect, open and empty and is ready for use.

Referring to FIG. 10, a polythene bag 11 having substantially the same dimensions as the container is placed within the container through the open top of the container. A cardboard insert 12 (or made of another type of material) is inserted into the bag 11 and has a shape and dimensions corresponding generally to those of the floor of the container.

The mouth of the bag 11 is turned down over the top edges of the container, and the bag is then filled with elastic tape 13. The tape is arranged within the bag so as to fill the bag without any coiling or snagging or knotting and with the two ends 13*a* and 13*b* of the tape emerging from the open mouth of the bag.

In FIG. 10, the tape 13 is shown in a highly schematic manner for the purpose of illustration, in fact the tape is densely packed to completely fill the bag 11. A flat-bottomed tray or cover 14 with reinforcing ribs 14a is then placed inside the bag 11 and is pushed downwards to compress the tape 13 into the bag. The two free ends 13*a* and 13*b* of the tape 13 are laid in the tray 14 so as to be readily available for use. The mouth of the bag 11 is then folded in over the tray 14. Finally, the roof panel 6 is closed over and is secured in the closed position by snap on clips (not shown) of approximately the same shape and dimensions as the hinges.

The roof panel 6 is shown in FIG. 10 about to be closed. After the roof panel is closed, the container becomes ready for transport from the elastic tape manufacturer to the elastic tape user. The latter, on receiving the container, opens the roof panel 6, removes the tray 14 and can then pull out tape 13 as desired.

To return the container to the elastic tape manufacturer, the container must be collapsed from the erect state after all the tape 13 has been dispensed. The first step is to remove the bag 11. When in the erect state, the floor panel 5 rests on the two brackets 8. These brackets 8 are at a level slightly above the lower edge of the front panel 1, left hand side panel 2 and right hand side panel 3. As a result, these three panels 1, 2, 3 are prevented from pivoting about hinges 10, and thus the container retains its square erect state.

Therefore, to collapse the container, the second step is to pivot the floor panel 5 from the horizontal position to the vertical position. Thereafter, the front panel 1, left hand side panel 2, rear panel 4 and right hand side panel 3 may be collapsed towards one another so that instead of forming an erect square parallelogram (as seen in plan), they form a collapsed substantially flat parallelogram with the floor panel 5 folded up into the parallelogram resting against the inside face of the rear panel 4 and with the roof panel 6 folded down outside the parallelogram resting against the outside face of the rear panel 4. The container can then be conveniently returned for re-use.

FIG. 10 also illustrates an optional feature not illustrated in FIG. 9, namely handgrips 15 provided in the left hand side panel 2 (not visible) and in the right hand side panel 3 and corresponding handgrips 16 in the tray 14 to facilitate handling of the container.

It will be appreciated that the container described above satisfies the need for an environmentally suitable container. All the elements, including the container proper, the polythene bag and the tray can be reused. Also, all of the elements are simple to manufacture. In particular, the container is of simple and durable construction.

FIGS. 1–4 depict the container in accordance with the present invention that differs from the container of FIGS. 9 and 10 as concerns the particular hinged connection 10 (see FIGS. 9–10) that is between the front panel I and the left hand side panel 2; FIGS. 1–4 identify the counterpart as hinged connection 20. The rest of the components may be considered the same, except that the tape or strip material need not be, but preferably is, elastic.

Referring to FIG. 1, the container is initially in a closed condition when received from the strip material manufacturer. For the sake of clarity, the cover panel 6 is omitted from FIG. 1; the bottom panel is hidden by the flexible bag but is the same as shown in FIG. 9.

After a user opens the cover panel 6 (see FIGS. 2–3) and removes any insert or compression pad 44 (see FIG. 8—to be discussed later), the user then opens the bag 11 and drapes the top portion of the bag loosely over the panels so it lies against the exterior facing side of the side panels. The user then locates the leading end of the strip material 50 (see FIG. 4) for dispensement and locates the trailing end of the strip material 50 for tying to the leading end of other elastic material in another container as desired. The strip material 50 preferably is elastic.

Referring to FIG. 2, the fastener 26 is disengaged to enable the front and left side panels to be pulled apart from each other to form a gap by pulling at least one handle 46 outwardly. Preferably, all the panels are displaced into positions out of substantial confining contact with the bag 11 so as to relax tension and thereby eliminate tension spikes caused by snags of the strip material.

As explained previously, tension spikes arise during dispensement when a loop of the strip material becomes trapped or snagged between the side of the container (within the bag) and the adjacent strip material. Under such a condition, the tension spike will be induced by the trapped or snagged loop where it is taut. During dispensement of the strip material at high speeds under a set tension for a given application, such tension spikes prevent the tension of the strip material from remaining uniform.

Referring to FIG. 3, the next step is to fold the top open end of the bag 11 to make on opening for dispensing the strip material and yet avoid interfering with the free dispensement of the strip material as shown in FIG. 4. The top open end of the bag 11 could be pulled over the side panels as shown and pulled down, but if the bag became taut there is a risk that tension spikes may form during dispensement. Therefore, it is preferable that the top portion of the bag remain loose, preferably folded inward upon itself in a nesting manner to extend upwardly, so that tension is not applied on the bottom portion of the bag.

Preferably, the cover panel 6 is rotated sufficiently to lie against the adjoining panel to which it is hinged as depicted in FIG. 3. However, if its hinged connection is such that it does not permit the full rotation of the cover panel 6 to the position of FIG. 3 (e.g., only as far as in FIG. 2), the cover panel 20 should be capable of rotation at least over ninety degrees from its closed horizontal position to avoid interfering with the vertical dispensement of the strip material.

Ideally, the front, rear, left and right side panels should be displaceable away from the bag 11, thereby leaving the sides of the bag 11 free of the confining force of the panels entirely during dispensement of the strip material. The bag itself substantially retains its shape despite the removal of such panels, but any snags of loops of the strip material otherwise present due to the confining pressure exerted by the panels should be gone. One way for the panels to be displaceable is to provide for the spring-tensioned fastener 26 of FIG. 7 at preferably two diagonally opposite, if not all, vertically extending edges of the container between adjacent panels so as to relieve the confining forces all around the bag. A respective handle 46 would be provided on each panel to facilitate swinging them apart in the same manner shown for the front panel 1.

Figure 5:
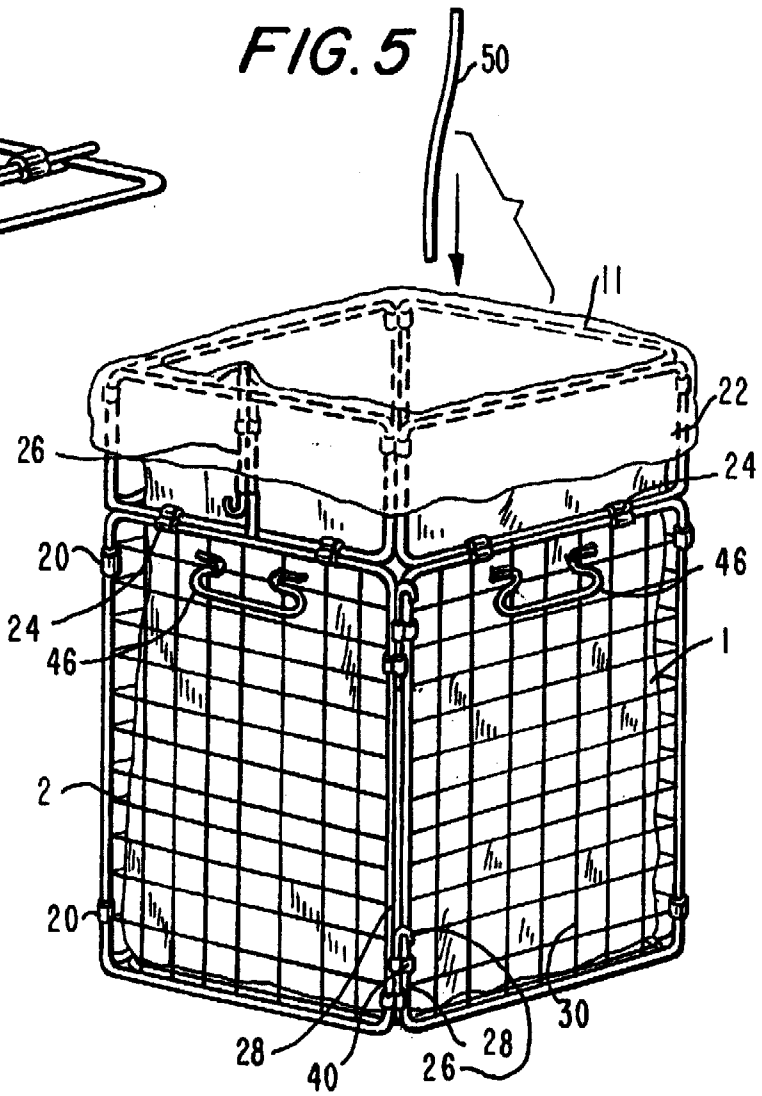
FIG. 5 is a perspective view of the a variation of the container of FIG. 1. Elastic strip material is being deposited into a bag confined within the container.

FIG. 5 depicts a variation of the container of FIGS. 1–4, the main difference being the use of four flaps 22 in place of the roof panel 6. The flaps are hinged to a top edge of a respective one of the front, rear, left side or right side panels by openable hinges 24. Two inner flaps are to fold in first, then the two outer flaps fold over them for closing the container. When the flaps are in the raised position as shown in FIG. 5, they may be held together at their corners with an engaging hook and loop material or any other suitable holding material so that they are retained in the raised position.

The flaps 22 may be held in place to extend upward in a vertical orientation as shown in FIG. 5 during filling and during dispensement of the strip material. The bag 11 should be long enough for its open end to be draped or folded over the top of the flaps while the strip material still rests on the floor panel. Such draping is recommended during the filling of the bag 11 with strip material.

During dispensement, the flaps are preferably in a raised position so as to not allow material to spill out over the sides, as may otherwise occur in response to removal of the insert or compression pad 44. Where the strip material 50 is elastic and is under some amount of compression exerted by the compression pad during shipment, removal of the compression pad 44 allows the elastic strip material to resiliently expand upward. The raised flaps contain the elastic strip material even after it has expanded upon the release of its compression from the pad 44.

The open end of the bag 11 may then be folded inwardly and nested within the confines of the inwardly facing sides of the flaps. For instance, the top of the bag is pulled up to an upper level of the flaps, folded inwardly and pulled downwardly until reaching about the level of the strip material and then folded back up. The folded portions are pressed against the inward facing sides of the flaps. The procedure is repeated as many times as necessary until all the loose bag material above the strip material is pressed against the flaps.

The construction of the bag, e.g., plastic, is preferably such that the folded top portion tends to retain its shape when so folded within the confines of the flaps. For instance, the plastic bag may have a tendency to cling to itself to avoid toppling on its own into the bottom portion when released, which would interfere with the dispensement.

The nested and folded top portion of the bag is relatively loose within the container so that the bottom portion does not become taut, which could give rise to tension spikes forming during dispensement. However, the bag could be of a dimension such that draping the top portion over the top edges of the container will not cause the bottom portion to become taut, in which case no tension spikes would form during dispensement. In either case, the top portion of the bag defines an opening through which may be dispensed the elastic strip material.

The two outer flaps have a retainer spring pin closure 26 for keeping them in a closed, locked state. Such a retainer spring pin closure is known conventionally for use in other applications and will be explained further in connection with FIG. 7. The remaining panels are hinged together by hinges 20 as in the embodiment of FIGS. 1–4.

Figure 6:
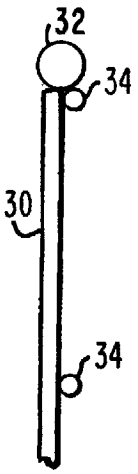
FIG. 6 is an elevational view of a wall section of the container of FIG. 5.

FIG. 6 shows a portion of the front wall 1, which has a frame perimeter and vertical wires 30 arranged flush on the inside with the frame 32. The vertical wires 30 are the spaced apart verticals forming the interior grid of FIG. 5. Spaced apart from each other along the length of the vertical wire 30 are horizontal wires 34 that represent the horizontals on the interior grid of FIG. 5. Hinges 24 are located at corner areas between adjoining panels in the manner shown and at least two corners of one side of the front panel 1 have spring pin closures 26 as does one of the flaps 22. Additional spring pin closures may be provided on the other side of the front panel so that the front panel may be swung open on the other side. Each vertical edge of the panels may have its own spring pin closure 26.

Figure 7:
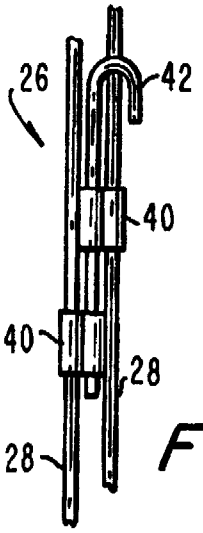
FIG. 7 is an elevational view of a spring closure of the container of FIG. 5.

FIG. 7 shows the spring pin closure 26 whose construction and operation is conventional. As shown, two adjoining panels each have adjoining frame perimeter sections 28 each with a closing receptacle element 40. This element has a grasping portion that is secured onto the frame perimeter section 28 and a tubular portion in alignment with its counterpart on the other element 40.

A spring-loaded hook pin element 42 is biased into the locking position where its elongated shank portion passes through both tubular portions of the receptacle elements 40. The end of the elongated shank portion of the hook pin element 42 may be pulled out one of the tubular portions against the spring bias, thereby compressing the spring and releasing the locking engagement between the panels. The spring is secured to the other of the tubular elements in a known manner. Once the hook pin element 42 is released, it displaces back to its uncompressed state under spring tension.

The spring pin closure 26 represents one way of locking and unlocking adjacent panels from each other, but it should be understood there are many other conventional ways of accomplishing the same result, such as with conventional latches commonly found in use on gates. All such conventional techniques are incorporated into the invention as viable alternatives to the spring pin closure 26.

Figure 8:
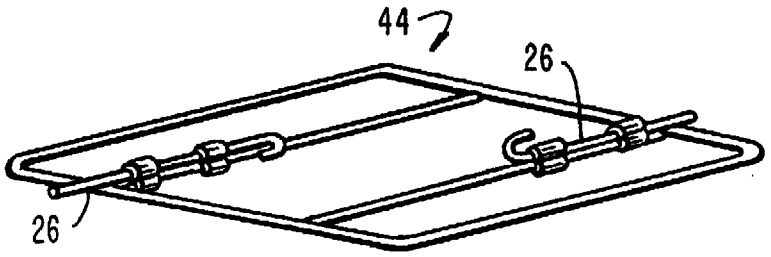
FIG. 8 is a perspective view of an insert or compression pad for use with the container of FIG. 5.

FIG. 8 shows the insert or compression pad 44 with two spring pin closures 26 for securing the pad in place at the top of the container. In this case, the elongated pins of the spring closure may fit through openings in the grid of the container to retain the pad in position. The pad 44 is made of any suitable non-compressible material and is intended to prevent the bag of strip material from moving around within the container during shipment.

A handle 46 is mounted on either of the front panel 1 (as shown in FIGS. 1 and 2) or on the left hand side panel 2 for assisting in the pivoting of the front panel relative to the left hand side panel 2 by manual pulling so as to create a gap between these panels. By swinging open the front panel 1, confining forces exerted through the bag 11 on the strip material 50 by the panels is relieved. Such handles are recommended for each of the embodiments.

By relieving the confining forces, the subsequent pulling out of the strip material takes place with reduced friction than would otherwise be the case. This allows the strip material in the bag to relax or resiliently return to its untensioned state because of the space afforded by the gap, which results in a freer (less frictional) discharge of the strip material due to the elimination of a condition in which tension spikes may form during dispensement.

Such tension spikes arise due to the formation of snags such as in the situation in which a loop of strip material becomes stuck between a wall of the container and adjacent strip material due to the cascading effect or displacement caused by harmonics build-up in the strip material during transit. A tension spike may be of momentary or sustained duration until the strip material becomes free of its snag. However, the tension spike could cause the strip material to break due to its enhancement of tension. Even if it does not cause breakage, the end product being made will no longer have a consistent tension, leading to degradation in the quality of the end product.

The container of the present invention eliminates the creation of such tension spikes during dispensement by relieving confining forces on the bag from the panels. This is accomplished by displacing the panels from a confining position to a relaxed position. In the relaxed position, confining forces are no longer exerted on snagged strip material by the panels.

For instance, an adjoining two panels may be opened and pushed apart from each other and the remaining panels moved away from the bag so as to relieve the confining forces all around the inner periphery of the bag. In this manner, snagged loops of strip material between the panels and adjacent strip material are loosened, thereby eliminating the condition that gives rise to the creation of tension spikes during dispensement. That is, the bag and therefore the periphery of the strip material will no longer be under compression by the panels that could give rise to the tension spikes. The bag itself could be physically removed from the container and placed down elsewhere; such would also eliminate the tension spikes during dispensement. The shape of the removed bag will remain substantially the same as it was within the container. Thus, the container should be displaceable to facilitate relief of the confining forces.

In addition, the container is still collapsible, which provides environmental benefits for recycling. Environmental benefits flowing from recyclability include avoidance of the need to procure and dispose of presently used corrugated packaging arrangements, easy collapsibility and return for continued use in business. Such recyclability should save money over conventional systems which rely on corrugated carton procurement and disposal.

Other advantages include improving packaging arrangements by allowing shrink wrapped steel container cartons on pallets, avoiding the need for corner boards, lowering flammability risks, making higher stacking arrangements possible, and increasing resistance to damage in transit. Also, operators may visually monitor the high speed discharge of the strip material at users' machines, which permits early detection of possible problems in the discharge.

The container of the present invention may be made of any sturdy, recyclable panel construction for accommodating the bag of strip material therein, such as sturdy plastic, wood or metal, provided the panels are displaceable into a position for relieving the confining forces imposed on the bag and thereby on the snagged loops of strip material. The material of the container may be either metal, sturdy plastic, wood or any other recyclable sturdy material. If recyclability is not a concern, the container may be constructed of less durable materials, such as corrugated cardboard.

While the generally rectangular box-shape for the container is well suited for efficient stacking of a large number of such containers, any other geometry for the container is envisioned by the present invention as well, whether cylindrical, prism shaped, etc. as long as wall panels or a portion of the wall may be swung open to relieve confining forces on the bag within the container and thereby on the strip material during dispensement.

The bag is preferably transparent or translucent so that, with the panels having a grid construction, an operator may readily watch the level of the strip material being dispensed simply by looking through openings in the grid and through the wall of the bag. However, the invention is not limited to the panels having such a grid construction and arranged to resemble a cage. For instance, to permit such viewing, the panels may be of a perforated solid wall construction instead to allow viewing through the perforations or may have a transparent unperforated construction.

Further, the panels need not allow an operator to view through them. That is, the panels need not be grid-like, but rather may be continuous, opaque and unperforated. Indeed, the panels may be taken away so they no longer are around the bag.

In a conventional manner, the leading and trailing ends of the strip material are arranged at the top of the bag to be readily accessible, preferably marked to be quickly recognized, such as by securing a piece of tape to each of the ends. Thus, once the bag is opened, the trailing end is accessible to be readily tied to a leading end of strip material contained within another container and the trailing end of strip material is accessible to be readily tied to a trailing end of strip material contain within another container or to a dispensement mechanism, as applicable.

Each of the various components depicted that comprise the embodiments of FIGS. 1–4, FIGS. 7–8 and FIGS. 9–10 are interchangeable with counterparts in any of the embodiments, except that the invention of FIGS. 1–4 and FIGS. 6–8 should relieve confining forces exerted on the bag during dispensement by allowing one of the front and adjacent side panels to be swung open. Also, where flaps are provided instead of a solitary cover panel as in FIGS. 6–8, it is preferable for the flaps to have provision for securing them to remain extended upwardly during the filling and dispensing of the bag with strip material. In all cases, the bag should be long enough so that its open end may be folded over the topmost edges of the container and pulled downward so as to help keep the bag taut in place while being filled.

While the foregoing description and drawings represent the preferred embodiments of the present invention, it will be understood that various changes and modifications may be made without departing from the spirit and scope of the present invention.

What is claimed is:

1. A method of eliminating tension spikes in strip material from arising during dispensement that are attributable to loops of the strip material being snagged, comprising the steps of:

imposing confining forces on strip material with a container in a confining position;

creating a condition that causes the strip material to snag with adjacent strip material during transit due to displacement of the strip material during the transit;

relieving the confining forces and thereby relaxing the snags by displacing the container so as to eliminate the creation of the tension spikes during the dispensement that otherwise may arise from unrelieved confining forces acting on the snags;

dispensing the strip material free of the tension spikes after the step of relaxing the snags;

raising flaps to an elevation higher than that of the panels and retaining said flaps at said elevation, said flaps being connected to said panels, removing a compression pad from the container that compresses said strip material, said strip material being elastic, and allowing said strip material to resiliently expand back to an uncompressed state so that a volume displaced by said strip material increases to such an extent that a top portion of said strip material rises above that of said panels and yet becomes confined by said flaps to prevent spillover of the strip material; and wherein the container has a plurality of panels hingedly connected together, the step of relieving including disconnecting and then swinging apart two adjacent ones of the panels relative to the other to relieve the confining forces exerted by the panels that are imposed on the strip material.

2. A method as in claim 1, further comprising the step of loosely folding a top portion of an open flexible bag before the step of dispensing so as to define an opening bounded within the confines of the container, the bag having a bottom portion that contains the strip material, the step of dispensing including dispensing the strip material through the opening in the bag defined by the loosely folded top portion.

3. A method as in claim 1, in combination with collapsing the container, further comprising the steps of emptying the strip material from the container by the step of dispensing, swinging closed the two adjacent ones of the panels, collapsing the container by pivoting a bottom one of the panels out of a position that keeps a remainder of panels from collapsing toward each other and then collapsing the remainder of the panels toward each other into a substantially flattened condition.

4. A method as in claim 1, further comprising the step of tying a trailing end of the strip material to a leading end of strip material in another container before the step of dispensing.

5. A method as in claim 1, wherein the container has confining walls and contains a flexible bag that in turn contains the strip material, the container being open for accessing the bag, further comprising the step of moving one of the bag and confining walls relative to each other so as to eliminate the tension spikes by releasing loops of the strip material from remaining snagged because of the confining walls exerting pressure against the strip material.

* * * * *